United States Patent [19]

Quo et al.

[11] Patent Number: 4,945,794

[45] Date of Patent: Aug. 7, 1990

[54] METHOD AND APPARATUS FOR FEEDING PRODUCE ITEMS TO CENTRIFUGAL SLICERS

[75] Inventors: Geoffrey Q. Quo; Philip W. Pound, both of Irving, Tex.

[73] Assignee: Frito-Lay, Inc., Dallas, Tex.

[21] Appl. No.: 229,434

[22] Filed: Aug. 8, 1988

[51] Int. Cl.[5] ..... B26D 3/28

[52] U.S. Cl. ..... 83/13; 83/403; 83/404.3; 83/703; 83/411.2; 83/411.5

[58] Field of Search ..... 83/13, 403, 404.1, 404.3, 83/404.4, 411 A, 417, 705, 703, 411.2, 411.5; 241/5, 86.1, 88.1, 95, 275

[56] References Cited

U.S. PATENT DOCUMENTS

| | | | |
|---|---|---|---|
| 284,078 | 8/1883 | Sherman . | |
| 1,483,803 | 2/1924 | Hartburg | 83/403 |
| 3,139,127 | 6/1964 | Urschel et al. . | |
| 3,139,130 | 6/1964 | Urschel et al. . | |
| 3,191,650 | 6/1965 | Lichko et al. | 241/86.1 |
| 4,391,172 | 7/1983 | Galland et al. | 83/403 |
| 4,523,503 | 6/1985 | Julian et al. | 83/403 |
| 4,625,606 | 12/1986 | Pinegar et al. | 83/403 |
| 4,648,296 | 3/1987 | Wisdom et al. | 83/403 |

*Primary Examiner*—Frank T. Yost
*Assistant Examiner*—Scott A. Smith
*Attorney, Agent, or Firm*—Bernard, Rothwell & Brown

[57] ABSTRACT

An apparatus and method for feeding whole produce items, especially those with peels, to a centrifugal slicer so as to maximize the amount of whole slices and retention of peel includes an insert block with a central vertical infeed passage, a plurality of horizontal radially extending passages from the central passage, the end of the passageway shaped to allow the product being sliced to wedge in the passageways and prevent product bounce and roll during slicing.

7 Claims, 1 Drawing Sheet

METHOD AND APPARATUS FOR FEEDING PRODUCE ITEMS TO CENTRIFUGAL SLICERS

BACKGROUND OF THE INVENTION

1. Field of the Invention

This invention relates to improvements in feeding produce items to centrifugal slicers so as to increase production and produce better sliced products.

2. Prior Art

Centrifugal slicers for slicing whole produce are well known in the art. Urschel Laboratories Inc. of Valparaiso, Ind. produces a number of commercially available slicers. One of the main uses of the Urschel centrifugal slicer is to slice potatoes as the first step in producing potato chips. However, they are capable of slicing a wide variety of other produce items such as raw apples, beets, mushrooms and the like.

In the operation of Urschel centrifugal slicers the produce items are placed onto a rotating impeller and are forced against the inner surface of a slicing head assembly by centrifugal force and vanes on the impeller. The slicing head assembly may include as many as eight separate slicing knives. As produce passes each knife in a smooth uninterrupted manner, a slice is produced and the slice passes outwardly of the slicing head. With the Urschel slicer a large number of slices can be produced within a short period of time. The standard Urschel Model CC slicer is not practical for slicing apples because of bruising, chipping and undue bouncing preventing a good slice from being obtained.

It is also known in the art to slice whole apples as an initial step in producing apple chips. See for example, U.S. Pat. No. 4,648,296 assigned to the assignee of this invention. In the apple chip product it is highly desirable that the peel of the apple stay on the slices and that the slices be intact, i.e., without holes and without breakage to produce a more satisfactory product both from the standpoint of aesthetics and organoleptic properties.

When feeding apples to an Urschel slicer utilizing the teachings of U.S. Pat. No. 4,648,296 the apples tend to initially bounce around as they are rotated against the slicing head and the blades tend to chip the skin or peel and a percentage of the slices produced tend not to be whole or complete slices. This leads to producing of slices which are not intact and do not have all of the peel on them. Moreover, with the single feed input disclosed in U.S. Pat. No. 4,648,296 the production rate tends to be slow, thus requiring additional slicers. In other words, while the device of U.S. Pat. No. 4,648,296 is satisfactory for its purpose, it has certain disadvantages in slicing apples including a slow production rate, a tendency to not leave the peel intact on the slices, a low centrifugal force and a tendency to allow the product to bounce which chips the peel and contributes to less than whole slices. There is a need in the art to correct these deficiencies.

SUMMARY OF THE INVENTION

This invention provides a product infeed apparatus for feeding centrifugal slicers of the type having an impeller rotatably mounted within a stationary head assembly and which has an insert block assembly mounted on the impeller having a vertically extending central passageway and a plurality (preferably three) of radially extending horizontally positioned product feed passageways extending from the vertical central passageway to the stationary slicing head. The outermost portions of the product feed passageways are shaped to prevent product roll during slicing. When feeding apples having the skin on them the apples are fed by gravity to the center of the rotary impeller through the central passageways and are centrifugally forced radially and horizontally outwardly from the center of the impeller through separate passageways and then held against rotation while slicing so that the amount of peel retained on the slices and the amount of whole slices is maximized.

DETAILED DESCRIPTION OF THE PREFERRED EMBODIMENT

Figure 1:
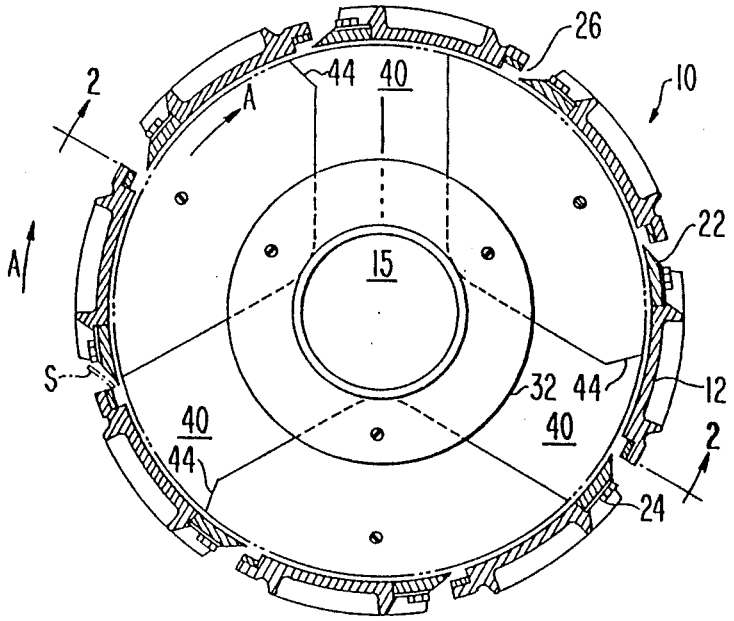
FIG. 1 is a top plan view partially in section of the apparatus of this invention in combination with a centrifugal slicer.
Figure 2:
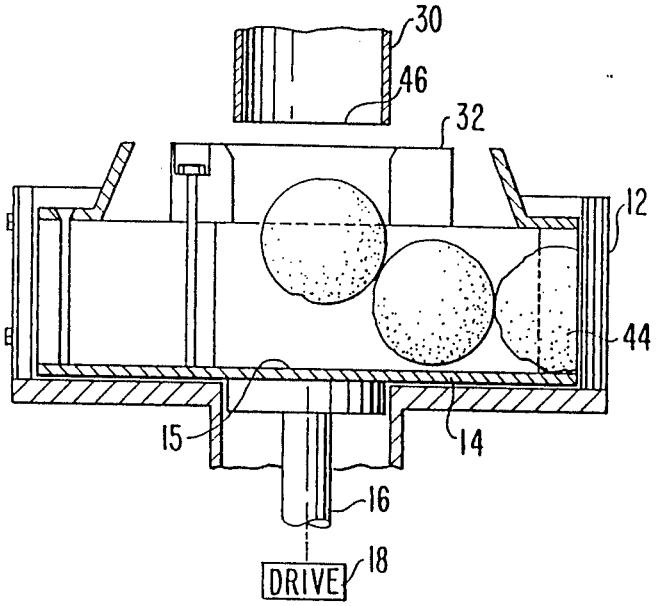
FIG. 2 is a sectional elevation view taken along line 2—2 of FIG. 1.

A centrifugal slicer 10 such as that manufactured by Urschel Laboratories Inc. of Valparaiso, Ind. (Model CC) includes a stationary slicing head assembly 12 which forms a generally cup-shaped enclosure within which an impeller 14 is rotatably mounted on a drive shaft 16 to be driven by a suitable driving means 18. The other components of the centrifugal slicer are well known in the art and exist on the market; therefore, only those components necessary for an understanding of this invention will be described.

The slicer's impeller would normally carry a plurality of blades which would force individual produce items such as potatoes against a plurality of stationary knives 22 in the slicing head assembly 12. Such blades are not included or used in the present invention. In the model of the Urschel slicer shown there are eight knives on slicing head assembly 12 each of which is suitably held in place by a knife clamp 24. There are eight corresponding gate inserts 26. The impeller normally rotates in the direction of arrow A to accomplish slicing by centrifugal force causing the produce items to bear against the knives 22 while impeller blades hold and move the items past the knives.

In prior art U.S. Pat. No. 4,648,296 the Urschel slicer is modified to provide single feed to the slicer from a feed tube such as feed tube 30. However, with that apparatus, incorporating a single, curved, smooth surfaced feed tube, centrifugal forces are limited and bouncing and indiscriminate rotation of the apples occurs before they are in a satisfactory position to begin slicing. As a result, portions of peel and even the tissue below the peel are removed prematurely, resulting in imperfectly shaped apple slices.

In the present invention there is provided a central infeed block 32 through which produce items such as apples are fed from feed tube 30 and dropped directly onto the center of top surface 15 of impeller 14.

For feeding the apples radially while exerting control of them there are three additional passages 40, all identical. Each of these passages extends radially outwardly from the center of the impeller 14 to the inner periphery of the slicing head 12. The dimensions of the infeed passage in the center infeed block 32 (which extends vertically) and the horizontally extending passages 40 are sufficiently great to handle the largest dimension of the apples being sliced. At the radially outward end of each of the passages 40 there is a holding means for holding the apples and preventing them from bouncing unduly, the holding means comprising a recess 44 at the outer end of each radial passageway 40, the recess extending in the trailing direction of rotation of the impeller. The shape and dimensions of these recesses 44 are chosen such that maximum wedging action is obtained. For example, the recess is cut away at approximately a 45° angle to the side of the corresponding passage 40, and may be further angled relative to the axis of the passage to assist in the wedging action.

In operation, items of whole produce, e.g., apples, are dropped from feed tube 30 through the center passageway of infeed block 32 and bounce on impeller 14. Because the impeller is rapidly rotating the centrifugal force of such rotation quickly forces the apples into first one and then another of the three passages 40. These passages 40 act to maintain control of the apples against the slicer blade 22 significantly reducing product roll and settling time before actual slicing begins. In addition, because the passages 40 are horizontal, they allow several apples to queue behind the apple being sliced thus providing a certain amount of head, i.e., weight, and thereby exerting additional centrifugal force on the product being sliced and further holding the fruit in place during slicing.

As a result the method and apparatus of this invention provides a significantly higher percentage of whole slices than a standard Urschel slicer where the product is permitted to roll and bounce within the impeller before actual slicing and where, with each bounce against the stator, a small piece of the peel is removed. Also by providing additional radial force within the impeller (which is not possible with U.S. Pat. No. 4,648,296) a significantly higher percentage of whole slices is obtained.

Comparison test data on percentage of non-whole slices obtained using a standard Urschel Model CC slicer impeller, the device of U.S. Pat. No. 4,648,296 and the device of the present invention under the same conditions are set forth in Table I below:

TABLE I

| | |
|---|---|
| Urschel slicer with standard CC impeller | 41.7% |
| Device of U.S. Pat. No. 4,648,296 | 18.2% |
| Device of this invention | 8.2% |

Moreover, the device of this invention can increase the production rate up to three times that of U.S. Pat. No. 4,648,296, and as a result, permits the reduction of capital and space required by up to 50% or more when compared with the slicer used in accordance with U.S. Pat. No. 4,648,296. The following example illustrates the use of the present invention:

EXAMPLE I

An Urschel slicer, Model CC, with the apparatus of this invention installed, was used for this example. The standard configuration employing eight slicer knives 22 was used. These were set with a gap of 2.67 mm (0.105 inches) between the tips of the knives 22 and the corresponding gate inserts 26.

Apple crates were unloaded and apples transferred through an inspection, washing, and sizing operation to an apple surge hopper. Upon receiving a start signal off slicer drive 18, apples were conveyed to the apple feeding mechanism, which is connected to feed tube 30. The lower end of the feed tube was centrally positioned above but not touching the inlet of infeed block 32.

Power for driving means 18 was initiated and, after reaching operating speed, impeller 14 was turning at 260 rpm, without load. After a short time delay following this start signal, the feed mechanism was then turned on and set to deliver apples at a rate of approximately 20–30 lbs. per minute. Apples passed through feed tube 30 and into rotating impeller 14 of slicer 10, where a steady stream of apples passed through the three passages 40 until a preset batch weight signalled the cessation of the run. The slices exiting the centrifugal slicer 10 were collected on a conveyor positioned beneath the slicer and transported away for further processing.

Although the invention has been described in connection with its preferred embodiment it is not intended to be limiting, the only limitation on the invention being the scope of the appended claims.

What is claimed is:

1. Product infeed apparatus for use with a centrifugal slicer of the type having an impeller rotatably mounted within a stationary slicing head carrying multiple knives and having exit gates adjacent the slicing knives for the exiting of slices, the infeed apparatus comprising:

(a) an insert block assembly mountable on the impeller;

(b) a vertically extending central passageway in the insert block assembly having a dimensional sectional area sufficiently large to handle product being fed to the slicer, the central passageway open at the top for infeed of product;

(c) a plurality of product feed passageways in the insert block assembly extending radially outward in a horizontal plane from the central passageway to the stationary slicing head, the product feed passageways having a dimensional sectional area sufficiently large to allow product being fed to be sliced to pass therethrough, each of the product feed passageways being non-rotatably about a central axis thereof and;

(d) product roll preventing means at the radially outer end of each of the product feed passageways to minimize movement of the product about the central axis of the product feed passageway during slicing so as to maximize the amount of whole slices.

2. An apparatus as in claim 1 wherein the product is a round fruit with a peel, the passages are circular in section, the central passageway extends vertically to the impeller, and the product roll preventing means at the radial outward end of the passages includes a passage shaped to hold and wedge the product being sliced.

3. An apparatus as defined in claim 2 wherein the product roll prevention means is a recess extending rearwardly in a direction opposite the direction of the rotation of the impeller for wedging the product therein.

4. An apparatus as defined in claim 3 wherein there are three product passageways.

5. A method of feeding whole produce items having peels to a centrifugal slicer of the type having a rotary impeller for centrifugally forcing produce items against a stationary slicing head assembly carrying blades for slicing the produce items, the slices passing outwardly through openings in the slicing head assembly, the method providing improved retention of peel on the slices and improved whole slices and comprising:

(a) feeding a plurality of produce items with peels by gravity to the center of the rotary impeller;

(b) centrifugally forcing the items radially outwardly from the center of the impeller through separate control paths in a horizontal plane, each of said paths having a central axis; and (c) holding the items forced radially outwardly against the blades of the slicing head assembly in a manner whereby the products are substantially non-rotatable about the central axis of the control paths to reduce product roll and bounce and prevent undue movement of items so that a greater amount of peel is retained on the slices and the amount of whole slices is maximized.

6. A method as defined in claim 5 wherein the forcing step comprises forcing the items through one of three respective separate radial passages corresponding to said control paths and spaced equally from each other around the periphery of the impeller and the produce items are apples.

7. In combination with a centrifugal slicer of the type having an impeller rotatably mounted within a stationary slicing head, the slicing head carrying slicing blades and having exit passages adjacent the slicing blades for exiting of slices, and an infeed insert block assembly mountable on a top face of the impeller, a central passageway extending vertically within the insert block assembly coincident with the axis of rotation of the impeller and dimensions sufficiently large to allow the product to be fed therethrough, the central passageway being open at the top for infeed of the product, a plurality of product feed passageways in the insert block assembly extending radially outwardly in a horizontal plane from the central passageway to the stationary slicing head, each of the product feed passageways having a central axis and being non-rotatable about said central axis, the product feed passageways having dimensional sectional area sufficiently large to allow the product being sliced to pass therethrough, and a product roll prevention means at the end of each of said radial passageways to prevent roll about said central axis of the products being sliced by causing them to wedge into recesses in the passageways during slicing so as to maximize the amount of whole slices and the amount of peel on such slices.

* * * * *